US008328394B2

(12) United States Patent
Lu et al.

(10) Patent No.: US 8,328,394 B2
(45) Date of Patent: Dec. 11, 2012

(54) LED BULB AND METHOD FOR MANUFACTURING THE SAME

(75) Inventors: Ying-Chieh Lu, Miao-Li Hsien (TW); Kuo-Feng Chiang, Miao-Li Hsien (TW); Zheng-Jay Huang, Miao-Li Hsien (TW); Kuo-Mang Lo, Miao-Li Hsien (TW); Chien-Ting Lu, Miao-Li Hsien (TW); Ying-Ching Chen, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 212 days.

(21) Appl. No.: 12/901,562

(22) Filed: Oct. 10, 2010

(65) Prior Publication Data

US 2012/0038271 A1 Feb. 16, 2012

(30) Foreign Application Priority Data

Aug. 13, 2010 (CN) ..... 2009 9 0127033

(51) Int. Cl.
*F21V 29/00* (2006.01)

(52) U.S. Cl. ..... 362/294; 362/346; 362/249.02; 313/498

(58) Field of Classification Search ..... 362/294, 362/346, 249.02, 800; 313/498
See application file for complete search history.

(56) References Cited

U.S. PATENT DOCUMENTS

| | | | | |
|---|---|---|---|---|
| 6,864,513 | B2 * | 3/2005 | Lin et al. | 257/99 |
| 7,347,589 | B2 * | 3/2008 | Ge | 362/294 |
| 7,396,142 | B2 * | 7/2008 | Laizure et al. | 362/240 |
| 8,226,273 | B2 * | 7/2012 | Lai | 362/294 |
| 2005/0068776 | A1 * | 3/2005 | Ge | 362/296 |
| 2005/0128752 | A1 * | 6/2005 | Ewington et al. | 362/294 |
| 2005/0243550 | A1 * | 11/2005 | Stekelenburg | 362/240 |
| 2009/0046473 | A1 * | 2/2009 | Tsai et al. | 362/373 |
| 2009/0237891 | A1 * | 9/2009 | Liu et al. | 361/714 |
| 2011/0121726 | A1 * | 5/2011 | Erchak et al. | 315/32 |

* cited by examiner

*Primary Examiner* — Ali Alavi
(74) *Attorney, Agent, or Firm* — Altis Law Group, Inc.

(57) ABSTRACT

An LED bulb includes a heat sink, a circuit, an LED, and a driving module. The heat sink includes a base, a tube extending downwardly from a first face of the base, and a plurality of fins extending outwardly from an outer circumference of the tube. The circuit is formed on a second face of the base, and the LED is disposed on the second face of the base and electrically connected with the circuit. The LED bulb further includes a first lead and a second lead electrically connecting with the circuit and extending through the base. The driving module includes a first electrode, and a second electrode electrically insulated from the first electrode and surrounding the first electrode. The first electrode of the driving circuit contacts with the first lead, and the second electrode of the driving circuit contacts with the second lead.

10 Claims, 3 Drawing Sheets

LED BULB AND METHOD FOR MANUFACTURING THE SAME

BACKGROUND

1. Technical Field

The disclosure relates to LED (light emitting diode) bulbs for illumination purpose and, more particularly, relates to an improved LED bulb which can be easily and conveniently assembled, and a method for manufacturing the LED bulb.

2. Description of Related Art

An LED bulb is a type of solid-state lighting that utilizes LEDs as a light source for indoor or outdoor illumination. An LED is a device for transferring electricity to light by using a theory that, if a current is made to flow in a forward direction through a junction region comprising two different semiconductors, electrons and holes are coupled at the junction region to generate a light beam. The LED has an advantage that it is resistant to shock, and has an almost eternal lifetime under a specific condition; thus, the LED bulb is intended to be a cost-effective yet high quality illumination device.

Generally, an LED bulb includes a base, a circuit layer formed on the base, a plurality of LEDs arranged on the base and electrically connected with the circuit, an electrical connector and a driving circuit. The driving circuit has two wires with different polarities. The two wires of the driving circuit are electrically connected with an external power source by the electrical connector. However, it is needed to test the polarities of the wires at first. The steps for testing are complicated. Furthermore, after testing the polarities of the wires, the position of the driving circuit may be adjusted in assembly of the LED bulb; therefore, the positions of the wires which have been tested for their polarities beforehand may be required to be changed accordingly; such manipulation is time consuming and laborious, which results in a low assembling efficiency.

What is needed, therefore, is an LED bulb which overcomes the above-mentioned limitations.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
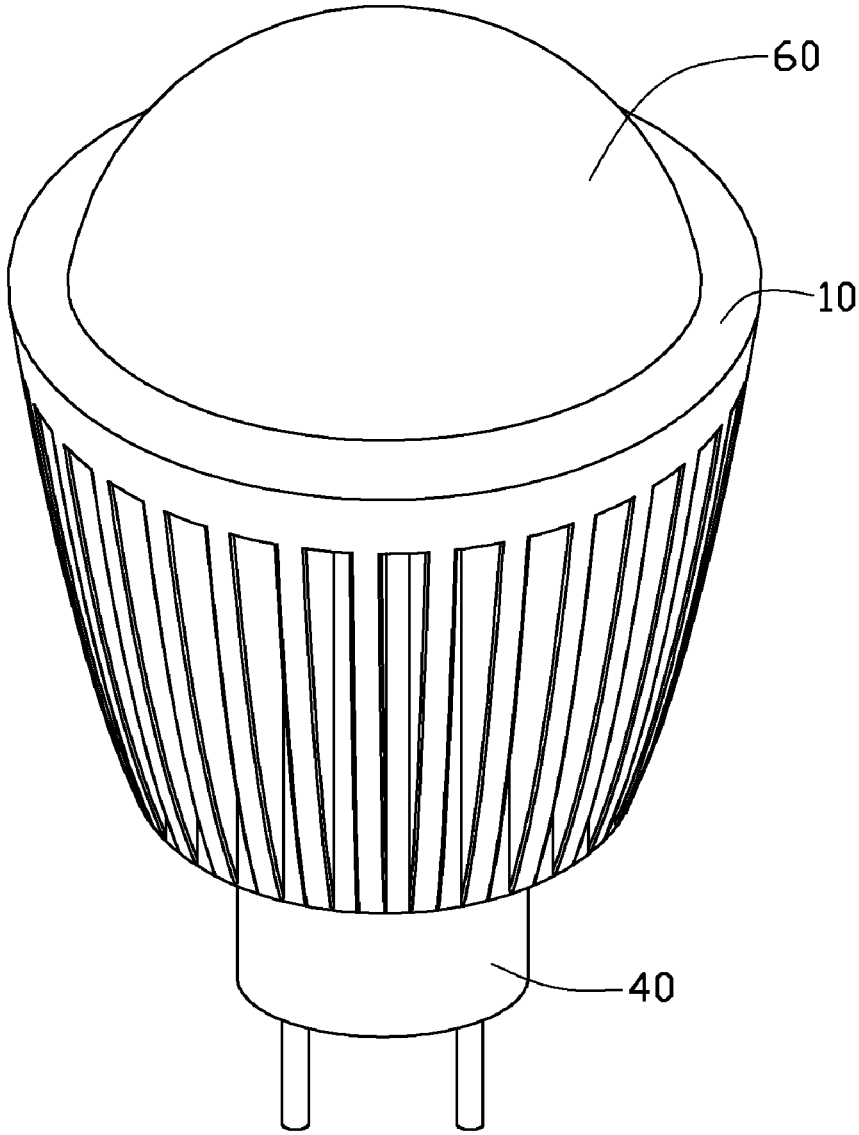
FIG. 1 is an isometric, assembled view of an LED bulb in accordance with an embodiment of the disclosure.
Figure 2:
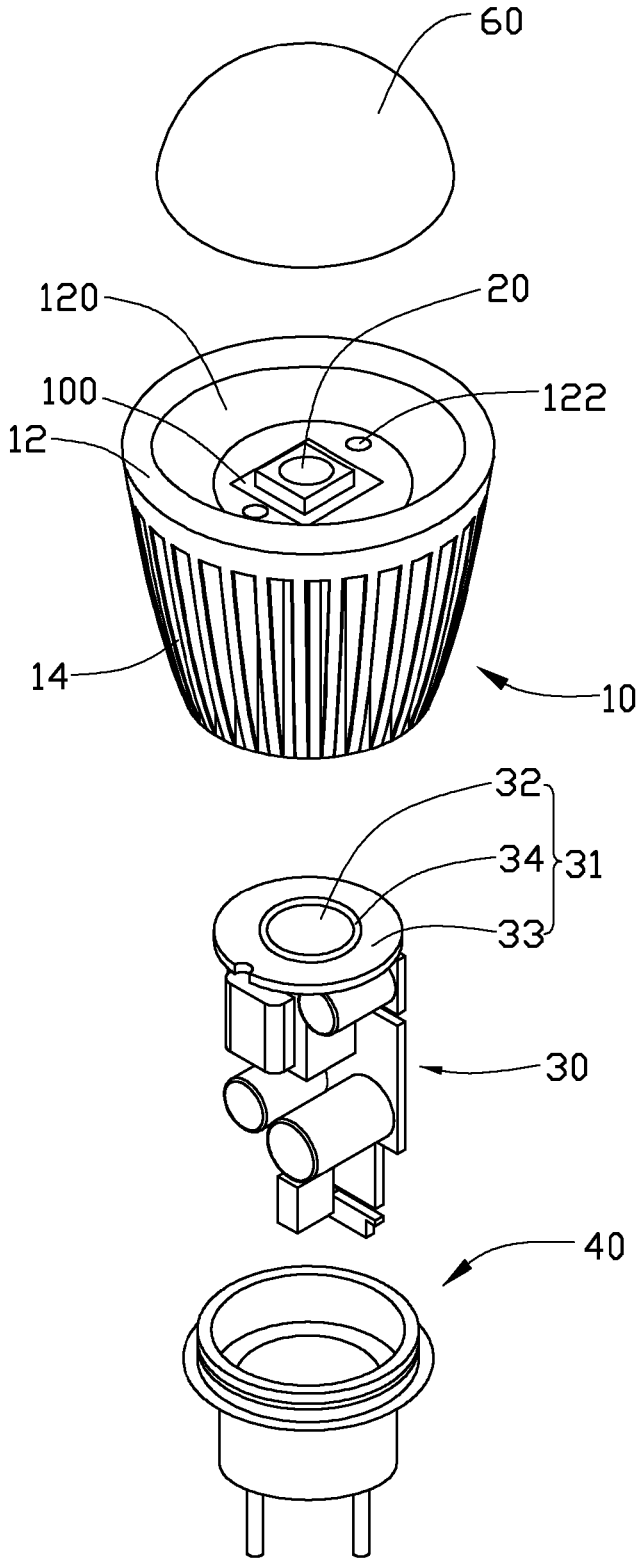
FIG. 2 is an exploded view of the LED bulb of FIG. 1.

Referring to FIGS. 1 and 2, a light emitting diode (LED) bulb in accordance with an embodiment of the disclosure is illustrated. The LED bulb comprises a heat sink 10, an LED 20 attached on the heat sink 10, a driving module 30 received in the heat sink 10, and a connector 40 electrically connected with the driving module 30.

Figure 3:
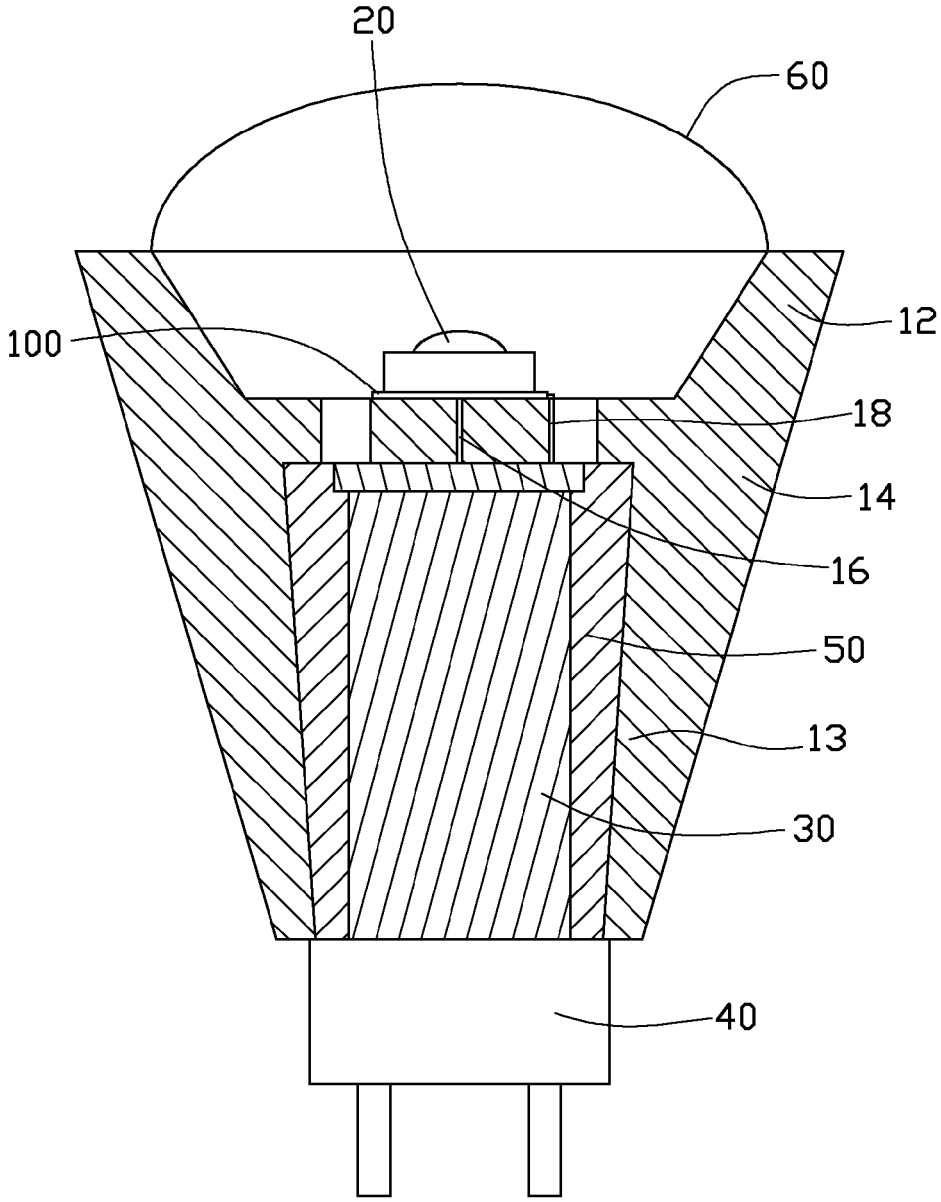
FIG. 3 shows a cross-sectional view of the LED bulb of FIG. 1.

Referring to FIG. 3 also, the heat sink 10 is integrally made of ceramic with good heat conductivity and electric insulation capability. The ceramic is made from materials selected from alumina, silicon dioxide, titanium dioxide, zirconia, yttria, calcium phosphate, silicon nitride, aluminum nitride, titanium nitride, boron nitride, black lead and tungsten carbide.

The heat sink 10 comprises a circular base 12, a tube 13 integrally extending downwardly from a bottom of the base 12, and a plurality of fins 14 integrally extending outwardly from an outer circumference of the tube 13. A top face of the base 12 is concaved downwardly to form a depression 120. The depression 120 has a flat face on which the LED 20 is attached. Two spaced through holes 122 are defined in the flat face of the depression 120 for extension of electrical wires (not shown) therethrough to electrically connect with the LED 20. The tube 13 extends perpendicularly and downwardly from a center of the bottom of the base 12. A diameter of the tube 13 is less than that of the base 12. The fins 14 are spaced from each other. The fins 14 are arranged radially relative to the tube 13. A passage is defined between every two neighboring fins 14. The fins 14 directly connect with the bottom of the base 12. The tube 13 defines a cavity at a center thereof, for accommodating the driving module 30 therein. A distal end (i.e., bottom end) of the tube 13 is engaged with the connector 40.

In the present embodiment, the LED bulb further comprises a first lead 16 and a second lead 18 electrically extending from a circuit 100 patterned on the flat top face of the base 12 in the depression 120, and running through the base 12 to a bottom face of the base 12. The first lead 16 is located near a center of the base 12, and the second lead 18 is formed through one through hole 122 of the base 12. In the present embodiment, the first lead 16 and the second lead 18 are metallic leads interconnecting corresponding surfaces of the base 12. The first lead 16 and the second lead 18 are electrically connected with the LED 20 through the circuit 100 formed on the flat face of the base 12.

The LED 20 is thermally disposed in the depression 120 of the base 12. It is understood that the number of the LED 20 is not limited to the present embodiment; the number of the LED 20 can also be two, three, etc.

The driving module 30 is received in the cavity of the heat sink 10, and electrically connected with the connector 40 and the LED 20. An insulated material 50 is filled in gaps between the driving module 30 and the tube 13. The driving module 30 is configured for providing driving voltage for the LED 20. A bottom of the driving module 30 is engagingly fixed to the connector 40.

The driving module 30 includes a disc-shaped contact portion 31. The contact portion 31 includes a first electrode 32, a second electrode 33, and an insulated layer 34 arranged between the first electrode 32 and the second electrode 33. In the present embodiment, the first electrode 32 is a circular anode and arranged at a center of the contact portion 31. The second electrode 33 and the insulted layer 34 are annular and concentric with the first electrode 32. The second electrode 33 is a cathode, and arranged at a periphery of the contact portion 31. The insulted layer 34 is made of insulating material, and configured for electrically insulating the first electrode 32 from the second electrode 33. A bottom end of the first electrode 32 is electrically connected with an anode of the connector 40, and a bottom end of the second electrode 33 is electrically connected with a cathode of the connector 40. Top ends of the first electrode 32 and the second electrode 33 are configured as power output ends of the driving module 30. It can be understood that the shape of the contact portion 31 is not limited to the circle as disclosed by the present embodiment; square or other shapes can also be used.

In the present embodiment, the driving module 30 is received in the hollow tube 13; therefore, the volume of the LED bulb can be reduced. Furthermore, a top face of the first electrode 32 of the contact portion 31 contacts the first lead 16, and a top face of the second electrode 33 contacts the second lead 18; therefore, the circuit 100 is electrically connected with the first electrode 32 and the second electrode 33 of the contact portion 31. In this embodiment, the contact portion 31 contacts a bottom face of the base 12. In alternative embodiment, the contact portion 31 is spaced from the bottom face of the base 12 and the first and second leads 16, 18 protrude downwardly beyond the bottom face of the base 12 to electrically engage with the first and second electrodes 32, 33, respectively.

The connector 40 is provided for electrically connecting with a power supply. The connector 40 is a standard plug which can be suited with conventional bulb sockets.

A method for forming the circuit 100 on the ceramic heat sink 10 comprises: (1) painting a layer of non-metallic material, selected from one of carborundum and boron nitride, on the top face of the base 12 in the depression 120 of the base 12; (2) calcining the ceramic heat sink 10 with the layer of non-metallic material; (3) forming the circuit 100 on the layer of non-metallic material in a manner of electroplating, sputtering deposition or evaporation deposition.

The LED bulb further comprises an envelope 60 disposed on a top of the heat sink 10 and correspondingly covering the LED 20. The envelope 60 is integrally formed of a transparent or semitransparent material such as glass, resin or plastic. The envelope 60 is fitly engaged with the depression 120 of the heat sink 10, whereby the envelope 60 cooperates with the base 12 to hermetically enclose the LED 20 therein for increasing the sealing performance of the LED bulb. Furthermore, the envelope 60 can function to modulate the light generated by the LED 20 to have a desired pattern.

It is to be understood, however, that even though numerous characteristics and advantages of various embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED bulb comprising:

a heat sink comprising a base, a tube extending downwardly from a first face of the base, and a plurality of fins extending outwardly from an outer circumference of the tube;

a circuit formed on a second face of the base;

an LED disposed on the second face of the base and electrically connected with the circuit;

a first lead and a second lead electrically connecting with the circuit and extending through the base; and a driving module comprising a contact portion, the contact portion comprising a first electrode, and a second electrode electrically insulated from the first electrode and surrounding the first electrode;

wherein the first electrode of the driving circuit contacts with the first lead, and the second electrode of the driving circuit contacts with the second lead to electrically connect the LED with the driving module;

wherein the first electrode is disc-shaped, the second electrode being arranged around a periphery of the first electrode; and wherein an annular insulted layer is arranged between the first electrode and the second electrode.

2. The LED bulb as described in claim 1 further comprising a connector electrically connected with the driving module and configured for electrically connecting with a power source to supply power to the LED bulb.

3. The LED bulb as described in claim 1, wherein the contact portion is disc-shaped.

4. The LED bulb as described in claim 1, wherein the heat sink is integrally made of a ceramic.

5. The LED bulb as described in claim 4, wherein the ceramic is made from materials selected from alumina, silicon dioxide, titanium dioxide, zirconia, yttria, calcium phosphate, silicon nitride, aluminum nitride, titanium nitride, boron nitride, black lead and tungsten carbide.

6. The LED bulb as described in claim 1, wherein a top face of the base is concaved downwardly to form a depression, the base has a flat top face in the depression, and the circuit is formed on the flat top face.

7. The LED bulb as described in claim 1, wherein the fins are spaced from each other, and an airflow passage is defined between every two adjacent fins.

8. The LED bulb as described in claim 7, wherein the fins are arranged radially relative to the tube.

9. The LED bulb as described in claim 1, wherein a layer of non-metallic material selected from one of carborundum and boron nitride is formed on the second face of the base, and the circuit is formed on the layer of non-metallic material.

10. An LED bulb comprising:

a heat sink comprising a base, a tube extending downwardly from a first face of the base, and a plurality of fins extending outwardly from an outer circumference of the tube;

a circuit formed on a second face of the base;

an LED disposed on the second face of the base and electrically connected with the circuit;

a first lead and a second lead electrically connecting with the circuit and extending through the base; and a driving module comprising a contact portion, the contact portion comprising a first electrode, and a second electrode electrically insulated from the first electrode and surrounding the first electrode;

wherein the first electrode of the driving circuit contacts with the first lead, and the second electrode of the driving circuit contacts with the second lead to electrically connect the LED with the driving module; and wherein a top face of the base is concaved downwardly to form a depression, the base has a flat top face in the depression, and the circuit is formed on the flat top face.

* * * * *

UNITED STATES PATENT AND TRADEMARK OFFICE

CERTIFICATE OF CORRECTION

PATENT NO. : 8,328,394 B2
APPLICATION NO. : 12/901562
DATED : December 11, 2012
INVENTOR(S) : Ying-Chieh Lu et al.

It is certified that error appears in the above-identified patent and that said Letters Patent is hereby corrected as shown below:

On the Title Page

Please replace Item (30) regarding "Foreign Application Priority Data" with the following:

(30) Foreign Application Priority Data

Aug. 13, 2010 (TW) .....99127033

Signed and Sealed this
Twenty-fourth Day of December, 2013

Margaret A. Focarino

Margaret A. Focarino
*Commissioner for Patents of the United States Patent and Trademark Office*